US012778181B2

(12) United States Patent
Da Rodda et al.

(10) Patent No.: US 12,778,181 B2
(45) Date of Patent: Nov. 3, 2026

(54) TOBACCO TREATMENT

(71) Applicant: BRITISH AMERICAN TOBACCO (INVESTMENTS) LIMITED, London (GB)

(72) Inventors: Cleber Da Rodda, London (GB); Gilson Rufino Sant'Anna, London (GB); Guilherme Sabin, London (GB); Samuel Kaiser, London (GB); Priscila Cruz, London (GB); Oscar Pontes, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 546 days.

(21) Appl. No.: 17/755,762

(22) PCT Filed: Nov. 6, 2020

(86) PCT No.: PCT/GB2020/052813
§ 371 (c)(1),
(2) Date: May 6, 2022

(87) PCT Pub. No.: WO2021/090016
PCT Pub. Date: May 14, 2021

(65) Prior Publication Data

US 2022/0400734 A1 Dec. 22, 2022

(30) Foreign Application Priority Data

Nov. 8, 2019 (GB) ..... 1916279

(51) Int. Cl.
*A24B 15/12* (2006.01)
*A24B 3/10* (2006.01)
(Continued)

(52) U.S. Cl.
CPC ..... *A24B 15/12* (2013.01); *A24B 3/10* (2013.01); *A24B 3/14* (2013.01); *A24B 15/24* (2013.01)

(58) Field of Classification Search
CPC ..... A24B 15/12; A24B 15/18; A24B 15/24; A24B 3/10; A24B 15/241; A24B 3/14
See application file for complete search history.

(56) References Cited

U.S. PATENT DOCUMENTS 3,742,962 A * 7/1973 Brochot ..... A24B 15/24 131/297
3,771,533 A * 11/1973 Armstrong ..... A24B 3/182 131/293
(Continued)

FOREIGN PATENT DOCUMENTS

CN 101204249 A 6/2008
CN 105852199 A 8/2016
(Continued)

OTHER PUBLICATIONS

"Tobacco Farming and Curing", Philip Morris International, https://www.pmi.com/tobacco-economics/tobacco-farming-and-curing#:~:text=Virginia%2C%20or%20flue%2Dcured%20tobacco,light%2C%20bright%20aroma%20and%20taste., Date accessed Aug. 21, 2024 (Year: 2024).*

*Primary Examiner* — Michael H. Wilson
*Assistant Examiner* — Stephanie Lynn Moore
(74) *Attorney, Agent, or Firm* — McKee, Voorhees & Sease, PLC

(57) ABSTRACT

The invention provides a process for treating tobacco material comprising: securing tobacco starting material within a sealed reactor preventing the ingress or exit of any gas or liquid; heating the tobacco material to a temperature of from about 60° C. to about 200° C. for a period of from about 6 hours to about 120 hours; allowing the temperature of the
(Continued)

tobacco material to cool down to about room temperature whilst secured within the sealed reactor; and removing treated tobacco material from the sealed reactor. It also provides tobacco material treated by the process, extracts from said tobacco material, and to products including the treated tobacco material or extracts.

27 Claims, 4 Drawing Sheets

(51) Int. Cl.
*A24B 3/14* (2006.01)
*A24B 15/24* (2006.01)

(56) References Cited

U.S. PATENT DOCUMENTS 4,497,330 A 2/1985 Banyasz et al.
4,607,646 A 8/1986 Lilly, Jr. et al.
5,230,354 A 7/1993 Smith et al.
6,048,404 A 4/2000 White
6,718,988 B1 4/2004 Cooper et al.
6,846,177 B1 * 1/2005 Hutchens ..... A24B 1/02 432/500
2006/0157072 A1 * 7/2006 Albino ..... A24B 15/243 131/270
2015/0027453 A1 * 1/2015 Tessmann ..... A24B 15/18 131/300
2015/0272201 A1 10/2015 Nunes De Oliveira et al.
2016/0249674 A1 9/2016 Benjak et al.
2016/0262445 A1 9/2016 Benjak et al.
2019/0174813 A1 6/2019 Benjak et al.
2019/0302069 A1 10/2019 Francisco Swenson Pontes et al.
2022/0400734 A1 * 12/2022 Da Rodda ..... A24B 3/10

FOREIGN PATENT DOCUMENTS

CN 109730352 A 5/2019
CN 109938396 6/2019
EP 0821886 A2 2/1998
EP 3643184 A1 4/2020

* cited by examiner

TOBACCO TREATMENT

CROSS REFERENCE TO RELATED APPLICATIONS

This is a U.S. national phase application claiming priority to PCT/GB2020/052813, filed Nov. 6, 2020, which claims priority to British application No. GB1916279.1, filed Nov. 8, 2019, the entire contents of which are hereby incorporated by reference in their entirety.

FIELD

The present invention relates to a process and, in particular, a process for the treatment of tobacco. It also relates to the tobacco material treated by the process, extracts from said tobacco material, and to products including the treated tobacco material or extracts therefrom.

BACKGROUND

After harvesting, tobacco material can be cured to prepare the leaf for consumption. The tobacco material may be further treated, for example by aging or fermentation, to enhance the organoleptic properties of the tobacco. However, these processes can be lengthy and the quality of the resulting tobacco material can be variable. Treatments to enhance or add flavours and aromas to the tobacco material at a later stage of tobacco processing often involve the addition of one or more additives to the tobacco and can require additional processing steps and equipment, which can be costly and time-consuming.

SUMMARY

According to a first aspect of the present invention, a process is provided for treating tobacco material, the process comprising: securing tobacco starting material within a sealed reactor preventing the ingress or exit of any gas or liquid; heating the tobacco material to a temperature of from about 60° C. to about 200° C. for a period of from about 6 hours to about 120 hours; allowing the temperature of the tobacco material to cool down to about room temperature whilst secured within the sealed reactor; and removing treated tobacco material from the sealed reactor.

In some embodiments, the tobacco material is heated to a temperature of from about 90° C. to about 120° C.

In some embodiments, the tobacco is heated for a period of from 12 to 72 hours.

In some embodiments, the cooling of the heated tobacco to room temperature occurs over a period of from at least about 1 hour to about 72 hours.

In some embodiments, the cooling allows volatile compounds to be reabsorbed by the treated tobacco material.

In some embodiments, the tobacco starting material has a moisture content of from about 5% to about 42%.

In some embodiments, the tobacco starting material comprises one or more selected from the group consisting of green tobacco and dried tobacco.

In some embodiments, the tobacco starting material comprises cured tobacco. In some embodiments, the cured tobacco is one or more selected from the group consisting of flue cured, air cured, dark air cured, dark fire cured and sun cured tobacco.

In some embodiments, the tobacco starting material is one or more selected from the group consisting of cut rag, thrashed leaf and tobacco stems.

In some embodiments, the tobacco starting material is reconstituted tobacco.

In some embodiments, the tobacco starting material comprises tobacco and one or more additives. In some embodiments, the one or more additive is selected from the group consisting of: sugars, organic acids (such as lactic acid), humectants, top flavours and casings.

In some embodiments, there is a reduction in the content of at least one selected from the group consisting of: total sugars, and ammonia in the treated tobacco material compared to the content in the tobacco starting material.

In some embodiments, the treated tobacco material has improved organoleptic properties.

In some embodiments, the treated tobacco material has reduced undesirable sensorial attributes.

In some embodiments, the tobacco material is agitated whilst being heated within the sealed reactor. Alternatively, in other embodiments, the tobacco material is not agitated whilst being heated within the sealed reactor.

In some embodiments, the tobacco is heated by a heat source which heats the external and/or internal surface of the sealed reactor.

According to a second aspect of the present invention, tobacco material is provided that has been treated according to the process of the first aspect.

According to a third aspect of the present invention, a tobacco industry product is provided, comprising the tobacco material of the second aspect.

According to a fourth aspect of the present invention, use of the tobacco material of the second aspect is provided for the manufacture of a tobacco industry product.

According to a fifth aspect of the present invention, a tobacco extract manufactured from the tobacco material of the second aspect is provided.

According to a sixth aspect of the present invention, a nicotine-delivery system comprising an extract according to the fifth aspect is provided.

According to a seventh aspect of the present invention, a delivery system for delivering tobacco alkaloids other than nicotine is provided, comprising an extract according to the fifth aspect.

BRIEF DESCRIPTION OF THE FIGURES

For the purposes of example only, embodiments of the invention are described below with reference to the accompanying drawings, in which.

DETAILED DESCRIPTION

Figure 1:
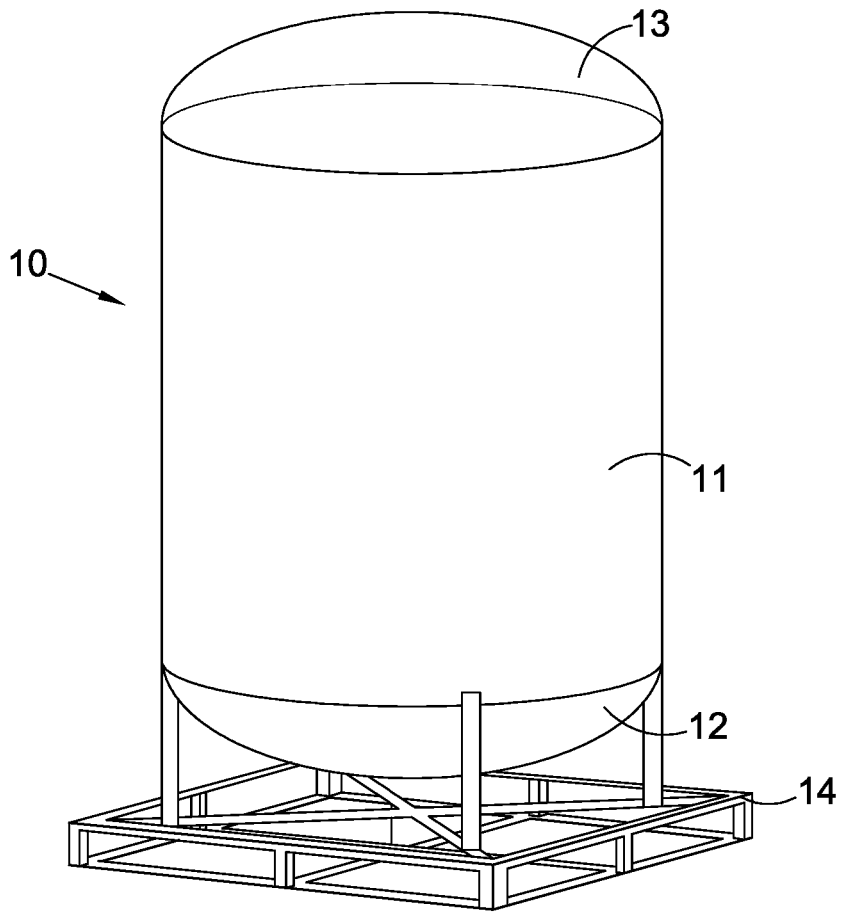
FIG. 1 shows an apparatus for carrying out the claimed process.

The present invention relates to a process for the treatment of tobacco material. The treatment may enhance the organoleptic properties of the tobacco material, of an extract from the tobacco material and/or of an aerosol formed from the tobacco material or extract. As used herein, the term "treated tobacco" refers to tobacco that has undergone the treatment process, and the term "untreated tobacco" refers to (the same) tobacco that has not undergone the treatment process.

Tobacco undergoes a number of steps prior to consumption by the consumer. Tobacco is generally cured after harvesting to reduce the moisture content of the tobacco, usually from around 80% to around 20% or lower. Tobacco can be cured in a number of different ways, including air-, fire-, flue- and sun-curing. During the curing period, the tobacco undergoes certain chemical changes and turns from a green colour to yellow, orange or brown. The temperature, relative humidity and packing density are carefully controlled to try to prevent houseburn and rot, which are common problems encountered during curing.

At a Green Leaf Threshing (GLT) plant the tobacco usually undergoes the following steps: re-grading; greenleaf blending; conditioning; stem removal by de-stemming or threshing (or not in the case of whole leaf); drying; and packing.

In addition to curing, the tobacco may be further processed to enhance its taste and aroma. Aging and fermentation are known techniques for enhancing the taste and aroma of tobacco. These processes can be applied to tobacco materials such as threshed lamina, hand-stripped lamina, butted lamina and/or whole leaf tobacco.

Aging usually takes place after the tobacco has been cured, threshed (or butted or hand-stripped) and packed. Tobaccos that undergo aging include Oriental, flue-cured and air-cured tobaccos. During aging the tobacco might be stored generally at temperatures of around 20° C. to around 40° C. and relative humidities present at the respective country of origin/aging or under controlled warehouse conditions for around 1 to 3 years.

In conventional processing it is important that the moisture content of the tobacco is kept at a relatively low level during aging, for example up to around 10-13%, as mould will form in tobacco with higher moisture content.

Fermentation is a process that is applied to particular tobaccos, including dark air-cured tobacco, cured Oriental tobacco and cigar tobacco, to give the tobacco a more uniform colour and to change the aroma and taste. Fermentation is generally not applied to flue-cured and light air-cured tobacco.

The fermentation parameters, such as the moisture content of the tobacco and the ambient conditions, vary depending on the type of tobacco that is undergoing fermentation. Generally, the fermentation moisture is either similar to the moisture content of the tobacco when it has been received from the farmer (around 16-20%), or the tobacco is conditioned to a slightly higher moisture content. Care has to be taken to avoid the production of different rots, which occur when the tobacco is fermented at a moisture content that is too high. The duration of the fermentation period can vary, ranging from several weeks to several years.

Generally, fermentation involves the treatment of tobacco in large volumes and is applied to whole leaf, with subsequent removal of the stem after process. The tobacco can be arranged into large piles, which is then turned at intervals to move the tobacco at the periphery into the centre of the pile. Alternatively, the tobacco is placed into reactors with a volume of several square meters. Treatment of such large volumes of tobacco can be cumbersome and/or time-consuming.

Significantly, fermentation relies on the activity of microorganisms to effect changes in the tobacco material and the fermentation conditions, including temperature and moisture content of the tobacco, are selected to enhance the microbiological activity during fermentation. In most, if not all, cases the fermentation of tobacco relies upon microorganisms already present in the tobacco material. However, suitable microorganisms could potentially be added to the tobacco material at the start of the fermentation process.

After the above treatments, generally the tobacco is transported to other locations to be further processed, for example before it is incorporated into a tobacco-containing product. When the tobacco is being incorporated into a smoking article such as a cigarette, the tobacco is generally unpacked, conditioned, blended with other tobacco styles and/or types and/or varieties, cut, dried, blended other tobacco materials, such as dry-ice-expanded-tobacco, and handed over to the cigarette manufacturing department.

Tobacco may additionally or alternatively be treated with additives to improve or enhance the flavour and aroma of the tobacco. However, this requires additional processing steps and apparatus, making the tobacco preparation process more lengthy and often more costly. In addition, it can be desirable to have a tobacco material that has a taste and aroma that is enjoyed by consumers but has not had any additives applied to it to achieve this. This would be the case for consumers who would like a natural tobacco product that also has a pleasant flavour and/or taste, for example. Additives are generally applied in the location at which the smoking article is being produced, such as a cigarette factory, although the point at which additives are applied can vary.

The tobacco treatment processes of the present invention provide a simple and effective means for enhancing the properties of the tobacco starting material without relying upon fermentation. The process is also relatively fast compared to many know processes and involves a generally constant moisture content. In some embodiments, this constant moisture content means that the resultant treated tobacco material does not need to be dried significantly before use. In some embodiments, the addition of flavours to tobacco material that has been treated according to the processes disclosed herein can be reduced or avoided altogether as a result of the improved taste characteristics of the treated tobacco material itself.

The process for treating tobacco material comprises: securing tobacco starting material within a sealed reactor preventing the ingress or exit of any gas or liquid; heating the tobacco material to a temperature of from about 60° C. to about 200° C. for a period of from about 6 hours to about 120 hours; allowing the temperature of the tobacco material to cool down to about room temperature whilst secured within the sealed reactor; and removing treated tobacco material from the sealed reactor.

It is speculated that particular chemical transformations occur during the process, with various tobacco components, and especially the more volatile ones, involved in the reactions, as discussed in greater detail in the Examples.

The reactions and their products are dependent upon the processing conditions and can vary according to the conditions applied, including the temperature, processing time period, reactor and even additives inside the sealed reactor (which may be in gas, liquid or solid form).

Heating the tobacco material in the sealed environment to a temperature of from about 60° C. to about 200° C. for a period of from about 6 hours to about 120 hours has a number of effects on the material, causing physical and chemical changes. In some embodiments, the treatment process provides the treated tobacco material with beneficial organoleptic properties. For example, some treated tobacco has been found to exhibit the following advantageous properties when smoked: reduced mouth drying effect; significant irritation reduction; pleasant aftertaste; rich tobacco notes; mouth-watering sensation; reduced "cooked" taste; reduced off taste; and reduced "prickling". The taste profiles of the tobacco treated according to the processes disclosed herein are discussed in greater detail in the Examples.

Overall, the quality of the sensorial attributes of the treated tobacco material is greatly improved compared to the attributes of the same tobacco without the treatment. This renders the treated tobacco suitable for use in a variety of tobacco industry products, including cigarettes and tobacco heating products.

In some embodiments, the process of treating tobacco material as described herein produces a tobacco material with desirable organoleptic properties within a period of time that may be shorter than the more traditional techniques such as fermentation and aging and without the addition of flavour or aromatising additives. In some embodiments, the process of the present invention involves no fermentation or essentially no fermentation. This may be demonstrated by the presence of little or no microbial content of the tobacco material at the end of the process. Instead, the non-enzymatic Maillard reaction is responsible for many of the chemical changes occurring during the tobacco treatment.

Figure 5:
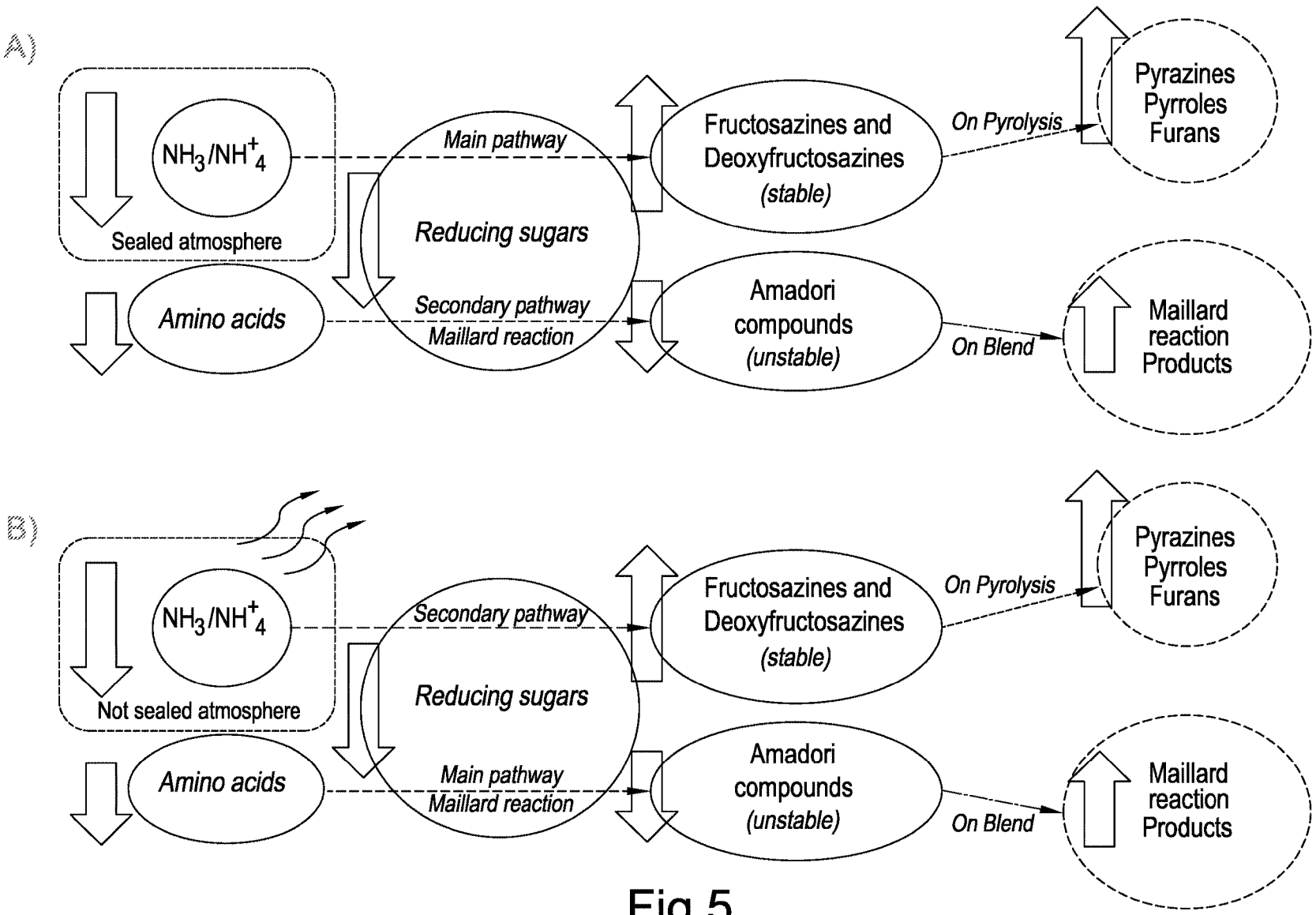
FIG. 5 is an illustration of the main degradation pathways of reducing sugars in processes as disclosed herein (A) and in the Browning process (B).

As demonstrated in the Examples, the chemical reactions that occur during the processes according to the present invention in a sealed environment are different to those observed during other tobacco treatment processes, including the processes disclosed in International Publication Nos. WO 2015/063485, WO 2015/063486 and WO 2015/063487 (referred to herein as the "Browning" process and conducted in an unsealed environment). The reactions are summarised in FIG. 5, which shows how the balance of the reactions is affected by the sealed environment preventing the escape of ammonium/ammonia despite their volatility. It is important to note that the size of the arrows in this figure indicates the magnitude of the change in the amount of the compound, whilst the arrow direction indicates whether the amount of the compound has increased or decreased in the chemical reaction.

As shown in FIG. 5A, upon heating the tobacco in a sealed environment in accordance with the processes disclosed herein, the sealed reactor retains the ammonium/ammonia so that the main reaction occurring is between the ammonium/ammonia and reducing sugars, producing stable fructosazines and deoxyfructosazines. On pyrolysis, these produce pyrazines, pyrroles and furans, which are associated with an increase in sweet, creamy, caramel and toasted notes in the treated tobacco. A secondary reaction pathway sees (to a lesser extent) amino acids reacting with the reducing sugars to produce Amadori compounds. These Amadori compounds are unstable at high temperatures and generate a wide range of degradation compounds, known as Maillard reaction products that have important contribution to flavour and aroma in the treated tobacco.

As shown in FIG. 5B, upon heating the tobacco in an unsealed environment in accordance with the Browning processes, the ammonium/ammonia can volatilize and some will escape from the reactor before reacting with the reducing sugars present. Therefore, the main degradation pathway of reducing sugar in the Browning process is the reaction of amino acids with the reducing sugars to produce Amadori compounds, leading to Maillard reaction products. The secondary degradation pathway involves the reaction of the reducing sugars with ammonium/ammonia to produce the stable fructosazines and deoxyfructosazines.

In some embodiments, the process of treating tobacco material as described herein produces a tobacco with an enhanced flavour profile or enhanced organoleptic properties (compared to the flavour profile of tobacco which has not been treated or which has been treated using only conventional curing processes). This means that there is a reduction in off-notes or irritants, whilst retaining the taste characteristics of the tobacco as would be seen following conventional curing. As used herein, the terms "enhance" or "enhancement" are used in the context of the flavour or organoleptic properties to mean that there is an improvement or refinement in the taste or in the quality of the taste, as identified by expert smokers. This may, but does not necessarily, include a strengthening of the taste.

In some embodiments, the process of treating tobacco material as described herein produces a tobacco material wherein at least one undesirable taste or flavour characteristic has been reduced.

In some embodiments, the process described herein may be used to enhance the organoleptic properties of a tobacco starting material which has poor organoleptic (e.g. taste) properties. It has been found that at least one effect that the processing has on the tobacco material is the removal or reduction of organoleptic factors that have a negative impact on the overall organoleptic properties of the tobacco material. In some embodiments, the process may also result in the increase of positive organoleptic properties.

In some embodiments, the process of treating tobacco material may be adjusted to produce a treated material with particular selected organoleptic characteristics. This may, for example, involve the adjustment of one or more of the parameters of the process.

In some embodiments, the temperature of the tobacco during the treatment process is from about 90° C. to about 120° C., or from about 100° C. to about 120° C., or from about 110° C. to about 120° C., or is about 110° C. Processing at about 90° C. leads to small, relatively subtle changes to the taste profile of the tobacco, including reductions in bright notes and hay notes, and an increase in dark, spicy and coffee notes. Processing at 110° C. and at 120° C. show marked increases in dark and spicy notes and reductions in bright and hay notes.

In some embodiments, the period of the treatment process is from about 12 hours to about 72 hours, from about 12 hours to about 60 hours, from about 12 hours to about 48 hours, or from about 24 hours to about 48 hours. The longer the processing period, the greater the changes to the flavour profile of the tobacco. Dramatic changes in the bright and hay notes are observed within 12 hours, especially at higher temperatures such as about 110° C. and about 120° C. At lower temperatures, the bright and hay notes are noticeably reduced within 24 hours and the effect increases with time. In order to achieve significantly increased dark, spicy and coffee notes, the processing period may need to be at least 24 hours and event from about 36 to about 60 hours, preferably at higher temperatures such as about 110° C. and about 120° C.

In some embodiments, the process of treating tobacco material as described herein transforms the flavour profile of the tobacco (compared to the flavour profile of tobacco which has not been treated or which has been treated using only conventional curing processes). This means that there is a significant change in the organoleptic properties of the tobacco following the processing, so that the taste characteristics of the tobacco are changed compared to those of the same tobacco following conventional curing. As used herein, the terms "transform" or "transformation" are used in the context of the flavour or organoleptic properties to mean that there is change from one overall taste or sensory character to another, as identified by expert smokers. This may include an improvement and/or refinement in the taste or in the quality of the taste.

In some embodiments, including those where the organoleptic properties of the tobacco starting material are transformed, the processing has the effect of not only reducing or removing organoleptic factors that have a negative effect, but also introducing or increasing organoleptic factors that have a positive effect. For example, in some embodiments, the process described herein leads to an increase in the products of the Maillard Reaction, many of which are known to contribute to desirable organoleptic properties.

Reference made herein to the organoleptic properties of the tobacco material may be reference to the organoleptic properties of the tobacco material itself, for example when used orally by a consumer. Additionally or alternatively, the reference is to the organoleptic properties of smoke produced by combusting the tobacco material, or of vapour produced by heating the tobacco material. In some embodiments, the treated tobacco material affords a tobacco product including said tobacco material with desirable organoleptic properties when said product is used or consumed.

In some embodiments, the physical appearance of the tobacco material changes as a result of the treatment process, with the treated tobacco having a darker and softer appearance.

In some embodiments, the chemical properties of the tobacco material changes as a result of the treatment process. In some embodiments, the treated tobacco exhibits a reduction in the total sugar content of from about 15% to about 90% compared to the same tobacco material prior to the treatment. In some embodiments, the treated tobacco exhibits a reduction in the ammonia content of from about 20% to about 80% compared to the same tobacco material prior to the treatment.

As shown in the Examples, the treatment of the tobacco material may lead to an increase in the products of the Maillard and caramelisation reactions, many of which are known to contribute to desirable organoleptic properties. The Maillard reaction is a chemical reaction between amino acids and sugars, and these are present in the tobacco starting material, but are seen in reduced quantities in the treated tobacco material. It is a non-enzymatic reaction which typically occurs at temperatures of from about 140 to 165° C. In addition to the pleasing effects of the Maillard reaction products on the organoleptic properties, the reaction is also responsible for the browning of materials. It has been observed that the tobacco treated in accordance with embodiments of the present invention has a darker brown colour than the tobacco starting material.

In some embodiments, the total sugar content of the treated tobacco is from about 30% to about 80% less than the sugar content of the tobacco starting material. In some embodiments, the total sugar content of the treated tobacco is from about 50 to about 85% less than the total sugar content of the tobacco starting material.

In some embodiments, the ammonia content of the treated tobacco is from about 30% to about 70% less that the ammonia content of the tobacco starting material. In some embodiments, the ammonia content of the treated tobacco is from about 60% to about 80% less that the ammonia content of the tobacco starting material.

In some embodiments, the tobacco material is treated in the presence of sugar, for example in an amount of from about 5% to about 25% by weight, from about 10% to about 20% by weight or about 15% by weight. In some embodiments the sugar is invert sugar. Processing in the presence of sugar results in a creamy and clean tobacco note, with a positive acid/sour note. There is an increase in the woody and coffee notes of the tobacco treated in the presence of inverted sugar. The organoleptic properties of this sugar-added treated tobacco are differentiated from the organoleptic properties of tobacco material treated in the absence of added sugar.

In some embodiments, the tobacco material is treated in the presence of sugar, for example in an amount of from about 5% to about 25% by weight, from about 10% to about 20% by weight or about 15% by weight, and lactic acid, for example in an amount of from about 5% to about 0.1% by weight, from about 3% to about 0.5%, or about 1% by weight. Adding both inverted sugar and lactic acid results in a major increase in the woody notes and minor increases in the coffee and spicy notes, as well as significant decreases in the hay and bread notes.

The process for treating tobacco material involves securing the starting material in a sealed reactor or vessel from which liquid or gas cannot exit. As the reactor and its contents are heated, the water present is also heated. When it reaches its boiling point, steam is generated. This steam is trapped within the reactor, resulting in an increase in the pressure within the reactor. As a general rule, increasing the temperature of chemical reactions by 10° C. doubles the rate of reaction. Thus, carrying out the process disclosed herein in a sealed reactor can result in reactions within the tobacco material occurring significantly faster than at atmospheric pressure, thus dramatically reducing the treatment period. The desired chemical changes to the tobacco material can therefore be observed within as little as 6 hours of treatment.

Furthermore, the processing in a sealed reactor means that the temperature of the tobacco material within the reactor is more uniformly increased upon application of heat. This too can help to reduce processing times, and also allows for larger batches of tobacco to be treated without compromising the quality of the product and the uniformity of the transformation.

In some embodiments, the tobacco material is heated for a period of from about 12 to 72 hours, or from about 12 to about 48 hours. The time period can have an impact on the chemical reactions and, as a consequence, can influence the extent to which the taste and flavour profile are altered in the final product.

The tobacco material secured in the sealed reactor is heated by applying a heat source to the reactor wall. In some embodiments, the reactor is heated in a heating chamber by the application of (indirect) hot air, steam or any other source of heating. The heating chamber preferably has a forced air circulation. In some embodiments, the reactors are made of food grade stainless steel. In some embodiments, the reactors are able to support high internal pressure.

In some embodiments, the reactor may have the capacity to hold and process tobacco loads of from about 300 g to about 150 kg, and even up to about 500 kg.

During the process, the tobacco material reaches the desired processing temperature within a short period of time and is maintained for the desired processing period. For example, in some embodiments, the tobacco material may reach the desired processing temperature within no more than about 4 hours, and optionally within no more than about 3 hours, about 2 hours, or about 1 hour. The time required for the tobacco to reach the desired processing temperature will depend upon the size of the reactor and the amount of tobacco being treated in the reactor.

Following the heating phase of the treatment process, the tobacco is allowed to cool whilst the tobacco remains within the sealed reactor. It is believed that this step allows the volatile compounds that volatilise during the heating of the tobacco to be reabsorbed by the treated tobacco material, thereby minimising the loss of important flavour components. Inside the sealed reactor during the cooling stage, the compounds volatilized in the vapour phase during the heating are condensed in association with water and reabsorbed by the tobacco material by passive transport. In some embodiments, the cooling of the tobacco takes place over a period of no more than about 24 hours, and optionally within no more than 12 or 6 hours.

In some embodiments, the heated tobacco material is allowed to cool slowly by removal of the heat source that was used to heat the material. Optionally, the heated tobacco material may be actively cooled, for example by exposing the sealed reactor to a lower temperature. This can accelerate the cooling of the temperature to approximately room temperature. In some embodiments, the active cooling of the heated tobacco material may result in its cooling to a temperature below room temperature.

As used herein, the term 'tobacco material' includes any part and any related by-product, such as for example the leaves or stems, of any member of the genus *Nicotiana*. The tobacco material for use in the present invention is preferably from the species *Nicotiana tabacum*.

Any type, style and/or variety of tobacco may be treated. Examples of tobacco which may be used include but are not limited to Virginia, Burley, Oriental, Comum, Amarelinho and Maryland tobaccos, and blends of any of these types. The skilled person will be aware that the treatment of different types, styles and/or varieties will result in tobacco with different organoleptic properties.

The tobacco material may be pre-treated according to known practices.

The tobacco material to be treated may comprise and/or consist of post-curing tobacco. As used herein, the term 'post-curing tobacco' refers to tobacco that has been cured but has not undergone any further treatment process to alter the taste and/or aroma of the tobacco material. The post-curing tobacco may have been blended with other styles, varieties and/or types. Post-curing tobacco does not comprise or consist of cut rag tobacco.

In some embodiments the tobacco starting material comprises cured tobacco. For example, the cured tobacco may be one or more selected from the group consisting of flue cured, air cured, dark air cured, dark fire cured and sun cured tobacco.

Alternatively or in addition, the tobacco material to be treated may comprise and/or consist of tobacco that has been processed to a stage that takes place at a Green Leaf Threshing (GLT) plant. This may comprise tobacco that has been re-graded, green-leaf blended, conditioned, de-stemmed or threshed (or not in the case of whole leaf), dried and/or packed. In some embodiments, the starting material is green tobacco or dried tobacco.

In some embodiments, the tobacco starting material is one or more selected from the group consisting of cut rag, thrashed leaf and tobacco stems.

In some embodiments, the tobacco material comprises lamina tobacco material. The tobacco may comprise between about 70% and 100% lamina material.

The tobacco material may comprise up to 50%, up to 60%, up to 70%, up to 80%, up to 90%, or up to 001% lamina tobacco material. In some embodiments, the tobacco material comprises up to 100% lamina tobacco material. In other words, the tobacco material may comprise substantially entirely or entirely lamina tobacco material.

Alternatively or in addition, the tobacco material may comprise at least 50%, at least 60%, at least 70%, at least 80%, at least 90%, or at least 95% lamina tobacco material.

When the tobacco material comprises lamina tobacco material, the lamina may be in whole leaf form. In some embodiments, the tobacco material comprises cured whole leaf tobacco. In some embodiments, the tobacco material substantially comprises cured whole leaf tobacco. In some embodiments, the tobacco material consists essentially of cured whole leaf tobacco. In some embodiments, the tobacco material does not comprise cut rag tobacco.

In some embodiments, the tobacco material comprises stem tobacco material. The tobacco may comprise between about 90% and 100% stem material.

The tobacco material may comprise up to 50%, up to 60%, up to 70%, up to 80%, up to 90%, or up to 100% stem tobacco material. In some embodiments, the tobacco material comprises up to 100% stem tobacco material. In other words, the tobacco material may comprise substantially entirely or entirely stem tobacco material.

Alternatively or in addition, the tobacco material may comprise at least 50%, at least 60%, at least 70%, at least 80%, at least 90%, or at least 95% stem tobacco material.

In some embodiments, the tobacco material to be treated may comprise and/or consist of reconstituted tobacco material.

In some embodiments, the moisture content of the tobacco material before and during treatment is between about 5% and about 42%.

When referring to "moisture" it is important to understand that there are widely varying and conflicting definitions and terminology in use within the tobacco industry. It is common for "moisture" or "moisture content" to be used to refer to water content of a material but in relation to the tobacco industry it is necessary to differentiate between "moisture" as water content and "moisture" as oven volatiles. Water content is defined as the percentage of water contained in the total mass of a solid substance. Volatiles are defined as the percentage of volatile components contained in the total mass of a solid substance. This includes water and all other volatile compounds. Oven dry mass is the mass that remains after the volatile substances have been driven off by heating. It is expressed as a percentage of the total mass. Oven volatiles (OV) are the mass of volatile substances that were driven off.

Moisture content (oven volatiles) may be measured as the reduction in mass when a sample is dried in a forced draft oven at a temperature regulated to 110° C.±1° C. for three hours±0.5 minutes. After drying, the sample is cooled in a desiccator to room temperature for approximately 30 minutes, to allow the sample to cool. Unless stated otherwise, references to moisture content herein are references to oven volatiles (OV).

In some embodiments, the moisture content of the starting material is from about 10% to about 20%, from about 10% to about 18%, from about 11% to about 16%, or from about 13% to about 18%.

Although the processing takes place in a sealed reactor which does not permit the exit of liquid or gas, the moisture content of the treated tobacco may differ from that of the starting material. In some embodiments, the moisture content of the treated tobacco material is from 0% to about 25% less than the moisture content of the tobacco starting material. In some embodiments, the moisture content of the treated tobacco is from 0% to about 20%, about 15% or about 10% less than the moisture content of the tobacco starting material.

FIG. 1 shows an apparatus suitable for carrying out the process disclosed herein. The apparatus 10 includes a cylindrical tank 11 have a curved bottom 12 and a hinged, curved lid 13 through which tobacco material to be treated may be added to the reactor within the tank. The tank is supported on a scaffold 14. A heat source (not shown) is used to heat the tobacco material within the reactor. This apparatus is merely indicative of an apparatus suitable for carrying out the processes disclosed herein.

The treated tobacco according to the present invention may be used in a tobacco industry product. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn (HnB) products; and c) other nicotine-delivery systems such as inhalers, aerosol generation devices including e-cigarettes, lozenges and gum. This list is not intended to be exclusive, but merely illustrates a range of products which are made and sold in the tobacco industry.

The treated tobacco material may be incorporated into a smoking article. As used herein, the term 'smoking article' includes smokeable products such as cigarettes, cigars and cigarillos whether based on tobacco, tobacco derivatives, expanded tobacco, reconstituted tobacco or tobacco substitutes and also heat-not-burn products.

The treated tobacco material may be used for roll-your-own tobacco and/or pipe tobacco.

The treated tobacco material may be incorporated into a smokeless tobacco product. 'Smokeless tobacco product' is used herein to denote any tobacco product which is not intended for combustion. This includes any smokeless tobacco product designed to be placed in the oral cavity of a user for a limited period of time, during which there is contact between the user's saliva and the product.

The treated tobacco material may be blended with one or more tobacco materials before being incorporated into a smoking article or smokeless tobacco product or used for roll-your-own or pipe tobacco.

Figure 2:
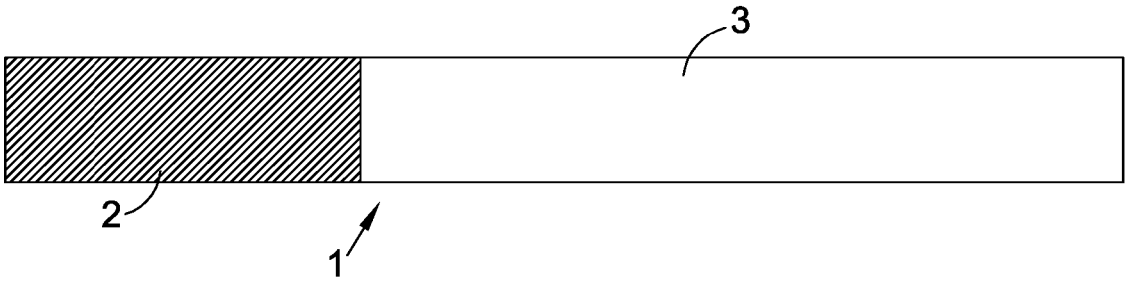
FIG. 2 is a schematic illustration of a smoking article including tobacco treated according to the claimed process.

Referring to FIG. 2, for purpose of illustration and not limitation, a smoking article 1 according to an exemplary embodiment of the invention comprises a filter 2 and a cylindrical rod of smokeable material 3, such as tobacco treated in accordance with the invention described herein, aligned with the filter 2 such that one end of the smokeable material rod 3 abuts the end of the filter 2. The filter 2 is wrapped in a plug wrap (not shown) and the smokeable material rod 3 is joined to the filter 2 by tipping paper (not shown) in a conventional manner.

EXAMPLE 1

Processes according to the invention were carried out using final blend cut rag and reconstituted tobacco as the tobacco starting material. Samples of the tobacco starting material were secured in a sealed reactor. The tobacco material in the reactor was then heated to a temperature of from 90° C., 110° C. and 120° C. for a period of 12, 24, 36, 48, 60 or 72 hours by applying a heat source. Following this treatment period, the heat source was removed and the treated tobacco material was allowed to cool to approximately room temperature whilst still secured within the sealed reactor. The treated and cooled tobacco was then removed from the sealed reactor.

The resultant treated tobacco was observed to have a darker and softer physical appearance. Chemical analysis of the treated samples showed that the sugar and ammonia content was reduced.

When the tobacco was combusted, the smoke was found to have improved sensorial attributes. The smoke had very low dryness and significant irritation reduction. It also had rich tobacco notes and a pleasant after-taste, as well as a mouthwatering sensation.

EXAMPLE 2

The aim was to identify the chemical markers of the treatment process of the present invention using an untargeted approach by UPLC-HRMS$^E$ previously established and published in International Patent Publication No. WO 2018/007789.

Sample Description

Ten control samples (P53) and ten samples of tobacco treated according to the processes disclosed herein, the so-called "SAT process" (P54) were evaluated. For comparison purposes, three comparison samples produced according to the so-called "Browning" treatment process disclosed in WO 2015/063485, referred to as Maltdorado tobacco, were also evaluated.

The control samples were the commercial Lucky Strike blend composition manufactured in the industrial plant in Brazil.

The SAT treatment samples were prepared using the same commercial Lucky Strike blend composition as the control samples, using processing parameters according to the invention disclosed herein.

The Browning samples were prepared using the same commercial Lucky Strike blend composition as the control samples. The Browning process involved processing 200 kg of the blend composition wrapped in a polyethylene liner (Polyliner), and exposed to the ambient processing conditions of 60° C. for a period of 30 days.

Sample Analysis

Dried samples were ground by ball-milling and sifted through sieves of 0.5 mm mesh. Aliquots of the powdered samples (200±5 mg) were transferred to 15 ml centrifuge tubes and extracted with 5 ml of methanol: water solution (1:1 v/v; aqueous phase) plus 5 ml of chloroform (organic phase) with sonication for 15 minutes followed by shaking at 250 rpm for 15 minutes. Next, the samples were centrifuged at 2,500 rpm for 5 minutes. Independent aliquots of 2 ml of organic phase (lower layer) and aqueous phase (upper layer) were filtered through a 0.22 μm filter (PTFE, Millipore®, USA), property diluted (20 times) and transferred to vials for UPLC-HRMS$^E$ analysis.

Equipment and Method

Three independent UPLC methods were employed for untargeted analysis, namely, apolar, semi-polar and polar methods. The aqueous phase was analysed in both polar and semi-polar methods in both electrospray ionization systems ($ESP^+$ and $ESI^-$) while the organic phase was analysed only in apolar method using $ESI^+$. All analyses were performed using an ACQUITY I-CLASS UPLC® (Waters®, USA) module coupled with high resolution mass spectrometry (HRMS) SYNAPT G2-Si® (Waters®, USA). The suitable system check (detector setup, mass calibration) was performed before each analysis batch. The data acquisition was performed at $MS^E$ resolution mode. The $MS^E$ mode allows one to obtain the low energy spectrum (MS spectrum) and high energy spectrum (similar to MS/MS spectrum) from the same run without discrimination or ion pre-selection. Nitrogen was used as nebulizer, cone and desolvation gas while argon was used as collision gas. In all analyses Leucine encephalin solution (1 μg/ml) was used for lock mass correction.

Putative Chemical Marker Identification

In order to identify the chemical nature of the compounds related to the treatment processes claimed herein, the exact monoisotopic mass and isotopic patterns of chemical markers obtained were compared with high resolution mass libraries (FooDB v 1.0, Lipidmaps, Chemspider, v 1.0 in-house tobacco library obtained from Rodgman et al, *The Chemical Components of Tobacco and Tobacco Smoke*, $2^{nd}$ Ed, CRC Press, 2013) using the Progenesis QI MetaScope. Thresholds of 10 ppm error in relation to theoretical monoisotopic mass and 85% in relation to isotopic pattern similarity were set as search parameters. In addition, the experimental fragmentation pattern (High energy mass spectrum) was compared with in-silico MS/MS fragmentation pattern using a threshold of 15 ppm error in relation to theoretical monoisotopic mass for each fragment. The chemical structure was confirmed by comparison of retention time and fragmentation pattern (High energy mass spectrum) in relation to standard compounds, if available.

Results

From initial exploratory analysis two principal components could be identified to explain more than 93% of total variability. The first component, responsible for 74% of total variability, showed convergence between the SAT and Browning samples in relation to chemical composition. In contrast, the second component, responsible for 19% of total variability, showed divergence between the SAT and Browning samples. Thus, the products generated by these processes showed significant differences in their chemical composition that give rise to differences in the sensorial perception evidenced between the different products.

Figure 3:
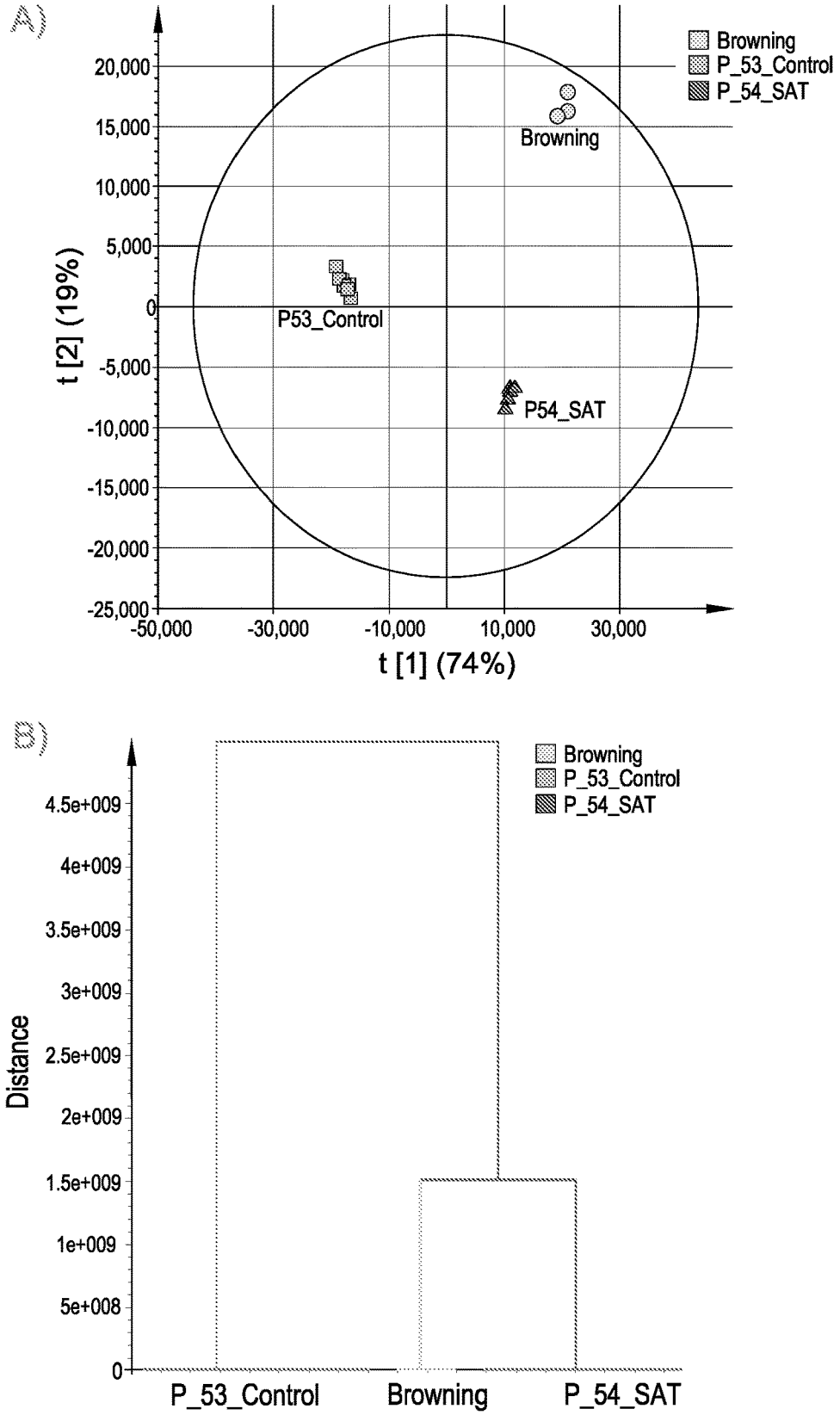
FIG. 3 is a score plot (A) and a dendrogram (B) obtained from principal components analysis (PCA) and hierarchical cluster analysis (HCA) comparing control samples and samples treated by a process as disclosed herein.

FIG. 3 shows a score plot (A) and dendrogram (B) obtained from principal components analysis (PCA) and hierarchical cluster analysis (HCA).

Figure 4:
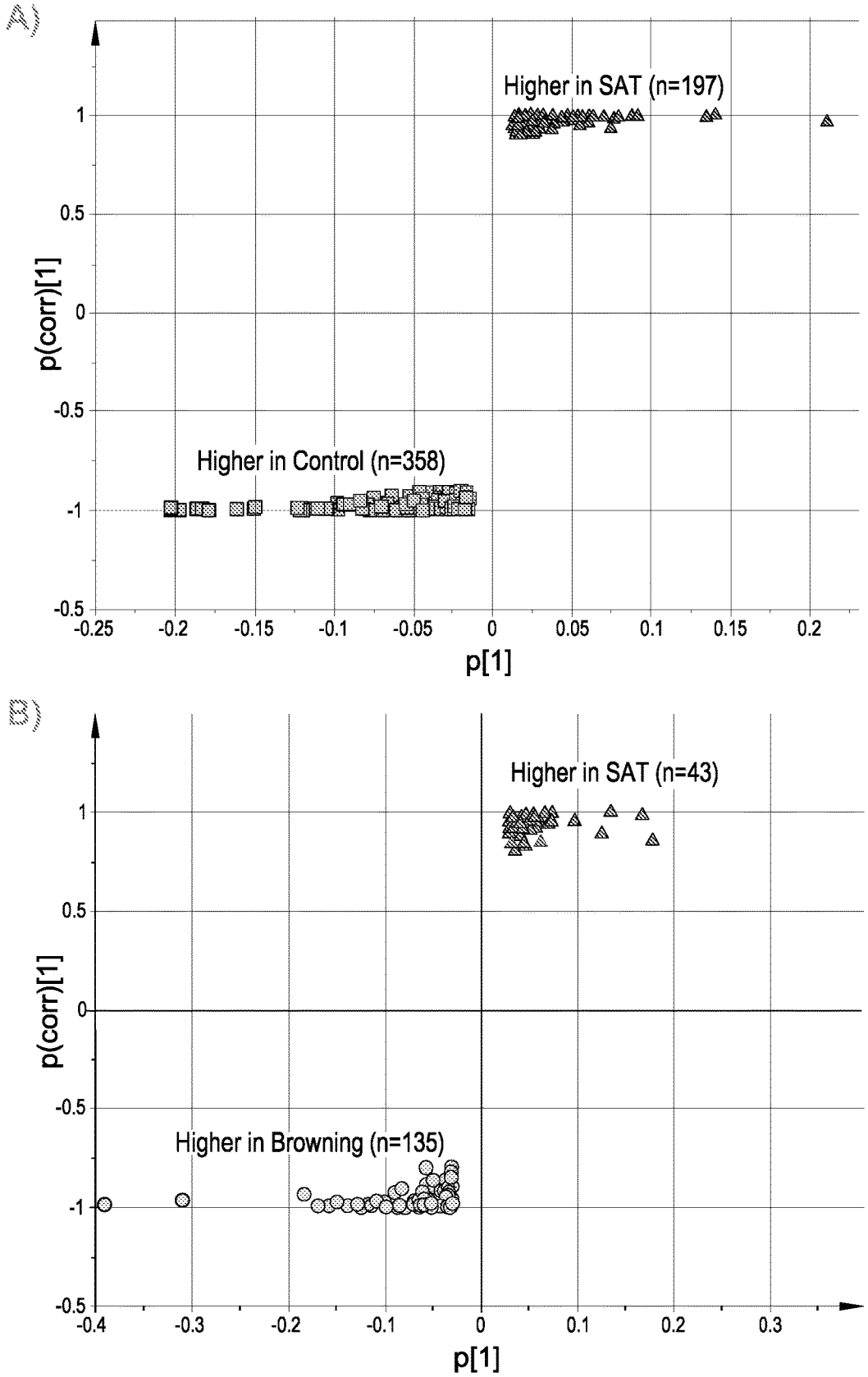
FIG. 4 is an S-plot from OPLS-DA model between control samples and samples treated by a process as disclosed herein (A), and between Browning samples and samples treated by a process as disclosed herein (B)

In order to identify the main chemical markers from the products of the SAT process, we performed independent discriminant analyses by orthogonal partial least squares (OPLS-DA) between the Control (P53) and SAT (P54) and between Browning and SAT (P54). The results are shown in FIG. 4, which shows an S-plot from OPLS-DA model. From a comparison between the Control (P53) and SAT (P54), 555 chemical markers were identified that showed significant changes after SAT process (see FIG. 4A). In addition, 178 chemical markers responsible for the differentiation between SAT and Browning process were identified (see FIG. 4B). More than 90 of these chemical markers could be putatively identified and the results are provided in Table 1.

TABLE 1

Chemical markers putatively identified from comparison between control (P53) and SAT (P54) and between Browning and SAT (P54)

| | Putative Identification | Chemical Class | SAT/ Control Ratio | SAT/ Browning Ratio |
|---|---|---|---|---|
| 1 | 2'-Deoxy-5-(1,3-thiazol-2-yl) cytidine | Amadori Compounds | 0.20 | 1.12 |
| 2 | D-Fructose,1-[(3-amino-1-carboxy-3-oxopropyl)amino]-1-deoxy-,(S)- | Amadori Compounds | 0.15 | 1.54 |
| 3 | N-(1-Deoxy-1-fructosyl) phenylalanine | Amadori Compounds | 0.20 | 1.08 |
| 4 | N-{[4-(4-Carbamimidoylphenyl)-3-methyl-2-oxo-1,3-oxazinan-6-yl]acetyl}-beta-alanine | Amadori Compounds | 0.27 | 8.89 |
| 5 | D-1-[(3-Carboxypropyl)amino]-1-deoxyfructose | Amadori Compounds | 0.10 | 2.75 |
| 6 | N-(1-Deoxy-1-fructosyl) proline | Amadori Compounds | 0.10 | 1.56 |
| 7 | N2-[(4,4-Dimethyl-2,6-dioxocyclohexylidene) methyl]glutamine | Amadori Compounds | 0.29 | 2.66 |
| 8 | O-(3,4-Dihydroxybenzoyl)-L-allothreonine | Amadori Compounds | 0.57 | 1.03 |
| 9 | N-[(Benzyloxy)carbonyl]-3-{[(1-{3-[(4,5-dihydro-1H-imidazol-2-ylamino) oxy]propanoyl}-4-piperidinyl)carbonyl]amino}-L-alanine | Amadori Compounds | 0.30 | 1.88 |

TABLE 1-continued

Chemical markers putatively identified from comparison between control (P53) and SAT (P54) and between Browning and SAT (P54)

| | Putative Identification | Chemical Class | SAT/ Control Ratio | SAT/ Browning Ratio |
|---|---|---|---|---|
| 10 | (3aR,4R,5R,6R,7aS)-4,5-Dihydroxy-6-(hydroxymethyl)hexahydro-1,3-benzoxazol-2(3H)-one | Maillard reaction products | 1.55 | 0.88 |
| 11 | 1,2,3,4,5,6-Hexahydro-5-(1-hydroxyethylidene)-7H-cyclopenta[b]pyridin-7-one | Maillard reaction products | 4.28 | 0.26 |
| 12 | 1,2,3,4,5,6-Hexahydro-7H-cyclopenta[b]pyridin-7-one | Maillard reaction products | 1.51 | 0.63 |
| 13 | 2,3,4,5,6,7-Hexahydrocyclopent[b]azepin-8(1H)-one | Maillard reaction products | 1.79 | 0.53 |
| 14 | 4-(2-Furanylmethylene)-3,4-dihydro-2H-pyrrole | Maillard reaction products | 1.80 | 0.67 |
| 15 | 5-(2-Furanyl)-1,2,3,4,5,6-hexahydro-7H-cyclopenta[b]pyridin-7-one | Maillard reaction products | 1.72 | 0.86 |
| 16 | Valine | Amino Acids | 0.76 | 2.45 |
| 17 | Phenylalanine | Amino Acids | 0.44 | 1.69 |
| 18 | Proline | Amino Acids | 0.49 | 1.30 |
| 19 | Tryptophan | Amino Acids | 0.18 | 0.71 |
| 20 | N-acetyltryptophan | Amino Acids | 0.30 | 2.73 |
| 21 | 3-amino-4,7-dihydroxycoumarin | Coumarin | 0.11 | 3.38 |
| 22 | Tomenin | Coumarin | 0.45 | 0.83 |
| 23 | Dihydrocaffeic acid 3-O-glucuronide | Polyphenols | 0.54 | 0.75 |
| 24 | Caffeic acid | Polyphenols | 0.56 | 0.49 |
| 25 | Chlorogenic acid | Polyphenols | 0.66 | 0.48 |
| 26 | Epicatechin-(4beta–>8)-epigallocatechin 3-O-gallate | Polyphenols | 0.65 | 0.69 |
| 27 | Kaempferol-3-Glucoside-3''-Rhamnoside | Polyphenols | 0.35 | 1.10 |
| 28 | Rutin | Polyphenols | 0.36 | 0.95 |
| 29 | 1-O-Caffeoylglucose | Polyphenols | 0.26 | 0.63 |
| 30 | 5-Hydroxy-2-(4-hydroxyphenyl)-4-oxo-4H-chromen-7-yl 6-O-(3,4-di-O-acetyl-6-deoxy-L-mannopyranosyl)-D-allopyranoside | Polyphenols | 0.60 | 0.64 |
| 31 | 5-Hydroxy-2-(4-methoxyphenyl)-4-oxo-4H-chromen-7-yl 2-O-acetyl-beta-D-allopyranoside | Polyphenols | 0.63 | 0.42 |
| 32 | Kaempferol 3-neohesperidoside | Polyphenols | 0.33 | 1.11 |
| 33 | Maysin | Polyphenols | 0.24 | 0.62 |
| 34 | Quercetin 3-O-glucosyl-rutinoside | Polyphenols | 0.63 | 0.60 |
| 35 | Scutellarein 6-xyloside | Polyphenols | 0.71 | 0.69 |
| 36 | (5-Hydroxy-6-methyl-3-pyridinyl)methyl alpha-D-glucopyranoside | Sugars | 0.65 | 21.30 |
| 37 | [5-Hydroxy-4-(hydroxymethyl)-6-methyl-3-pyridinyl]methyl beta-D-glucopyranoside | Sugars | 0.40 | 10.33 |
| 38 | 6-(alpha-D-Glucosaminyl)-1D-myo-inositol | Sugars | 0.23 | 2.19 |
| 39 | 6-O-(4-Aminobutanoyl)-D-glucopyranose | Sugars | 0.15 | 1.41 |
| 40 | D-Arabinofuranose | Sugars | 0.68 | 0.69 |
| 41 | Raffinose | Sugars | 0.20 | 1.82 |
| 42 | Trisaccharide like Raffinose isomer 1 | Sugars | 0.35 | 0.77 |
| 43 | Trisaccharide like Raffinose isomer 2 | Sugars | 0.30 | 1.59 |
| 44 | Trisaccharide like Raffinose isomer 3 | Sugars | 0.61 | 0.67 |

TABLE 1-continued

Chemical markers putatively identified from comparison between control (P53) and SAT (P54) and between Browning and SAT (P54)

| | Putative Identification | Chemical Class | SAT/ Control Ratio | SAT/ Browning Ratio |
|---|---|---|---|---|
| 45 | Sucrose | Sugars | 0.44 | 3.67 |
| 46 | 2-Deoxy-2-[(2-hydroxybenzyl) amino]-D-glucopyranose | Fructosazines & Deoxyfructosazines | 1.89 | 4.17 |
| 47 | 2-Deoxy-2-{[(2S)-2-({[(2-methyl-2-propanyl) oxy]carbonyl} amino) propanoyl]amino}-D-gluconyranose | Fructosazines & Deoxyfructosazines | 2.06 | 5.60 |
| 48 | D-Fructosazine | Fructosazines & Deoxyfructosazines | 1.73 | 4.87 |
| 49 | (1R,2S,3R)-1-(2-Methyl-4-pyrimidinyl)-1,2,3,4-butanetetrol | Fructosazines & Deoxyfructosazines | 3.18 | 5.53 |
| 50 | 2,5-Deoxyfructosazine | Fructosazines & Deoxyfructosazines | 3.22 | 5.26 |
| 51 | 2,6-Deoxyfructosazine | Fructosazines & Deoxyfructosazines | 2.27 | 4.57 |
| 52 | 4-(3-Methyl-2-pyrazinyl)-1,2,3-butanetriol | Fructosazines & Deoxyfructosazines | 3.09 | 2.32 |
| 53 | (3R,5R)-3-Amino-5-[(1R,2R)-1,2-dihydroxypropyl]dihydro-2(3H)-furanone | Furan derivatives | 2.99 | 3.90 |
| 54 | (4S,5R)-4-Amino-5-ethoxydihydro-2(3H)-furanone | Furan derivatives | 3.27 | 1.24 |
| 55 | 1-{2-[(2R,4S)-2-Methyl-5-oxo-4-propyltetrahydro-2-furanyl]-2-oxoethyl}tetrahydro-3,6-pyridazinedione | Furan derivatives | 3.62 | 0.27 |
| 56 | 2-(2-Furylmethyl)butanoic acid | Furan derivatives | 4.08 | 0.27 |
| 57 | 3-[(2R)-4-Ethyl-2-methyl-5-oxo-2,5-dihydro-2-furanyl]propanamide | Furan derivatives | 3.49 | 0.57 |
| 58 | {[6-Ethyl-2-(2-furyl)-4-oxo-4H-chromen-3-yl]oxy}acetic acid | Furan derivatives | 1.85 | 0.39 |
| 59 | 7-(2-C-Methyl-3-O-octanoyl-beta-D-ribofuranosyl)-7H-pyrrolo[2,3-d]pyrimidin-4-amine | Furan derivatives | 1.43 | 0.49 |
| 60 | (3R,4S,5S)-3,4-Dihydroxy-5-[(1R,2S)-1,2,3-trihydroxypropyl]dihydro-2(3H)-furanone | Furan derivatives | 4.08 | 0.28 |
| 61 | N-(Tetrahydro-2-furanylcarbonyl)-beta-D-glucopyranuronosylamine | Furan derivatives | 2.59 | 1.01 |
| 62 | (5S)-5-[(1R,4E,8E)-11-(3-Furyl)-1,6-dihydroxy-4,8-dimethyl-4,8-undecadien-1-yl]-5-methyldihydro-2(3H)-furanone | Furan derivatives | 1.63 | 1.24 |
| 63 | Levantenolide | Furan derivatives | 2.35 | 1.42 |
| 64 | 1-[1-(5-Methyl-2-pyridinyl)ethyl]proline | Pyridines, Pyrroles & Pyrazines | 1.92 | 0.94 |
| 65 | 2-(2,4-Cyclopentadien-1-ylidenemethyl)-1H-pyrrole | Pyridines, Pyrroles & Pyrazines | 0.63 | 1.06 |
| 66 | 2-{[3-Isobutyl-4-(L-prolyl)-2-pyridinyl]oxy}acetamide | Pyridines, Pyrroles & Pyrazines | 3.23 | 0.30 |
| 67 | 2-Methoxy-5-[(E)-2-(1-methyl-1,4,5,6-tetrahydro-2-pyrimidinyl) vinyl]phenol | Pyridines, Pyrroles & Pyrazines | 6.39 | 0.89 |
| 68 | Ethyl (2-hydroxy-1,4,6-trimethyl-1,2-dihydro-2-pyrimidinyl)acetate | Pyridines, Pyrroles & Pyrazines | 2.74 | 0.82 |

TABLE 1-continued

Chemical markers putatively identified from comparison between control (P53) and SAT (P54) and between Browning and SAT (P54)

| | Putative Identification | Chemical Class | SAT/ Control Ratio | SAT/ Browning Ratio |
|---|---|---|---|---|
| 69 | Ethyl (2S,3R,4R)-4-hydroxy-2-(3-hydroxypropyl)-5-oxo-3-pyrrolidinecarboxylate | Pyridines, Pyrroles & Pyrazines | 0.20 | 0.99 |
| 70 | L-alpha-Amino-1H-pyrrole-1-hexanoic acid | Pyridines, Pyrroles & Pyrazines | 0.39 | 0.52 |
| 71 | (2R,3R,4S,5R)-2-(Hydroxymethyl)-6-[(3-hydroxypropyl)amino]-2,3,4,5-tetrahydro-3,4,5-pyridinetriol | Pyridines, Pyrroles & Pyrazines | 2.13 | 1.35 |
| 72 | (10R)-10-Methyl-3,4,9,10,11,12-hexahydro[1]benzothieno[2',3':4,5[pyrimido[6,1-c][1,2,4]thiadiazine 2,2-dioxide | Pyridines, Pyrroles & Pyrazines | 2.36 | 2.10 |
| 73 | (Cyclohexylmethyl)pyrazine | Pyridines, Pyrroles & Pyrazines | 1.47 | 0.50 |
| 74 | 2-Amino-1-[(2S)-2-pyrrolidinylcarbonyl] cyclopentanecarboxylic acid | Pyridines, Pyrroles & Pyrazines | 2.62 | 0.48 |
| 75 | 6-({[(2R,3R)-3-Methyl-3,4-dihydro-2H-pyrrol-2-yl] carbonyl}oxy)-L-norleucine | Pyridines, Pyrroles & Pyrazines | 2.09 | 0.51 |
| 76 | Methyl [4-(2-pyrimidinyl) phenoxy]acetate | Pyridines, Pyrroles & Pyrazines | 0.40 | 1.49 |
| 77 | (2E)-2-[3-(Ethoxycarbonyl)-6-oxopyrazolo[1,5-a]pyrido[3,4-e] pyrimidin-7(6H)-yl]-2-butenoic acid | Pyridines, Pyrroles & Pyrazines | 0.13 | 0.61 |
| 78 | 2-Amino-5-(2,5-dimethyl-1H-pyrrol-1-yl)-4-hydroxybenzoic acid | Pyridines, Pyrroles & Pyrazines | 0.32 | 2.42 |
| 79 | 2'-Deoxy-N-[(dimethylamino) methylene]adenosine | Pyridines, Pyrroles & Pyrazines | 3.85 | 2.65 |
| 80 | (2S)-{[(2R,3R)-2-Amino-3-hydroxy-4-(4-hydroxyphenyl)butanoyl] amino}[(3S,4R,5R)-5-(2,4-dioxo-3,4-dihydro-1(2H)-pyrimidinyl)-3,4-dihydroxytetrahydro-2-furanyl] acetic acid | Pyridines, Pyrroles & Pyrazines | 0.46 | 1.00 |
| 81 | (7R,8aS)-7-(Hydroxymethyl) tetrahydro[1,3]oxazolo[3,4-a] pyridine-3,8(5H)-dione | Pyridines, Pyrroles & Pyrazines | 0.60 | 1.01 |
| 82 | 2,6-Bis(hydroxymethyl)-3-pyridinol | Pyridines, Pyrroles & Pyrazines | 2.47 | 1.04 |
| 83 | 4-[2-Hydroxy-3-methoxy-2-(methoxycarbonyl)-5-oxo-2,5-dihydro-1H-pyrrol-1-yl]butanoic acid | Pyridines, Pyrroles & Pyrazines | 0.55 | 1.07 |
| 84 | (2Z,6Z,10Z,14Z,18Z,22Z,26E,30E)-3,7,11,15,19,23,27,31,35-Nonamethyl-1-(4-morpholinyl)-2,6,10,14,18,22,26,30,34-hexatriacontanonaen-1-one | Carotenoids & Chlorophylls | 0.42 | 0.81 |
| 85 | 1'-Hydroxy-4-keto-gamma-carotene glucoside/1'-OH-4-Keto-gamma-carotene glucoside/(Carotenoid K-G) | Carotenoids & Chlorophylls | 0.51 | 0.66 |
| 86 | 2,4,6,8-Nonatetraen-1-ol,3,7-dimethyl-9-(2,6,6-trimethyl-1-cyclohexen-1-yl)-,(all-E)-{Retinol} | Carotenoids & Chlorophylls | 0.32 | 1.57 |

TABLE 1-continued

Chemical markers putatively identified from comparison between control (P53) and SAT (P54) and between Browning and SAT (P54)

| | Putative Identification | Chemical Class | SAT/ Control Ratio | SAT/ Browning Ratio |
|---|---|---|---|---|
| 87 | Pheophytin a | Carotenoids & Chlorophylls | 0.34 | 0.81 |
| 88 | Lutein | Carotenoids & Chlorophylls | 0.55 | 0.80 |
| 89 | 2-Cyclohexen-1-one,4-(2-butenylidene)-3,5,5-trimethyl-,(E,E)-{megastigmatrienone} - Isomer 1 | Caratenoids Degradation Products | 2.83 | 0.65 |
| 90 | 2-Cyclohexen-1-one,4-(2-butenylidene)-3,5,5-trimethyl-,(E,E)-{megastigmatrienone} - Isomer 2 | Caratenoids Degradation Products | 3.14 | 0.53 |
| 91 | β-Cembra-2,7,11-Triene-4,6-Diol | Cembranoids | 0.40 | 1.61 |
| 92 | α-Cembra-2,7,11-Triene-4,6-Diol | Cembranoids | 0.07 | 1.86 |

Thus, after the SAT process there could be seen a significant decrease in the content of reducing sugar, amino acids, Amadori compounds, polyphenols, carotenoids and chlorophylls. On the other hand, there was a significant increase in the content of carotenoids degradation products, pyridines pyrroles and pyrazines, furan derivatives, fructosazines/deoxyfructosazines and Maillard reaction products. From this is can be deduced that amino acids, reducing sugars and ammonium/ammonia appear to have a central role in the chemical reactions that occur in SAT process. Both ammonium/ammonia and amino acids can react with reducing sugars under heat, generating fructosazines/deoxyfructosazines and Amadori compounds, respectively, by the non-enzymatic Maillard reaction (Leffingwell, *Basic chemical constituents of tobacco leaf and differences among tobacco type,* Tobacco: Production, Chemistry, and Technology, Blackwell Science Ltd, 1999). While the fructosazines/deoxyfructosazines remain stable in the blend after their generation, the Amadori compounds are unstable at high temperatures and can generate a wide range of degradation compounds by fission or reduction (Nursten, *The Maillard Reaction: Chemistry, Biochemistry and Implications. Royal Society of Chemistry,* 2005), known as Maillard reaction products that have important contribution to flavor and aroma in the blend (Leffingwell, 1999). Moreover, the fructosazines/deoxyfructosazines can generate furans, pyrroles and a few number of simple pyrazines (2,5-& 2,6-dimethylpyrazine, trimethylpyrazine and tetramethylpyrazine) in smoke on pyrolysis (Leffingwell, 1999). Both Maillard reaction products in the blend and products of fructosazines/deoxyfructosazines pyrolysis can be associated with increasing of sweet, creamy, caramel and toasted notes verified after treatment with the SAT process.

The major difference verified between the tobacco treated by the so-called Browning process and SAT process is the content of fructosazines/deoxyfructosazines and Maillard reaction products. The fructosazines/deoxyfructosazines content was higher in the SAT treated tobacco than in the Browning treated tobacco due to the sealed atmosphere that can retain the ammonium/ammonia despite its volatility. As the Browning process is not conducted in a sealed environment, the ammonium/ammonia can volatilize before its reaction with reducing sugars. Therefore, the main degradation pathway of reducing sugar in the Browning process includes their reaction with amino acids while in the SAT process it comprises their reaction with ammonium/ammonia (see FIG. 5 which is an illustration of main degradation pathways of reducing sugars in SAT process (A) and Browning process (B)).

The decrease in ammonium/ammonia content can also reduce both blend and smoke pH. Consequently, the pH of blend and smoke after the SAT process has a lower pH than the control. This change in pH can modify the equilibrium between the free base nicotine and their salt complex. Therefore, the ratio of free base nicotine and their salt complex decreases with the more acid pH after SAT process, which can be associated with the sensory and physiological perception of decrease in the irritation/impact (Leffingwell, 1999). From a chemosensory evaluation of sensory attributes of smoke (WO 2018/007789) it was verified that the SAT process was associated with a reduction in irritation/impact. Moreover, the taste profile also changed after SAT process with increasing in dark notes, as well as spicy and woody notes. Table 2 shows the results of analysis of the control and SAT samples.

TABLE 2

Average results of moisture content, ammonia, ammonium, pH and total sugar content from blend analysis

| Blend analysis | Control (P53) | SAT (P54) |
|---|---|---|
| Moisture content (%) | 14.46 | 13.60 |
| Ammonia (μg/g) | 1117 | 306 |
| Ammonium (μg/g) | 1183 | 325 |
| pH | 5.48 | 4.97 |
| Total sugar content (%) | 9.05 | 4.07 |

Below it is shown how the production of fructosazines/deoxyfructosazines from the reaction of reducing sugars and ammonium/ammonia can release water to medium in the SAT process (Tshuchida et al, *Formation of Deoxyfructosazine and Its 6-Isomer by the Browning Reaction between Fructose and Ammonium Formate,* Agricultural and Biological Chemistry, v. 40, p. 921-925, 1976).

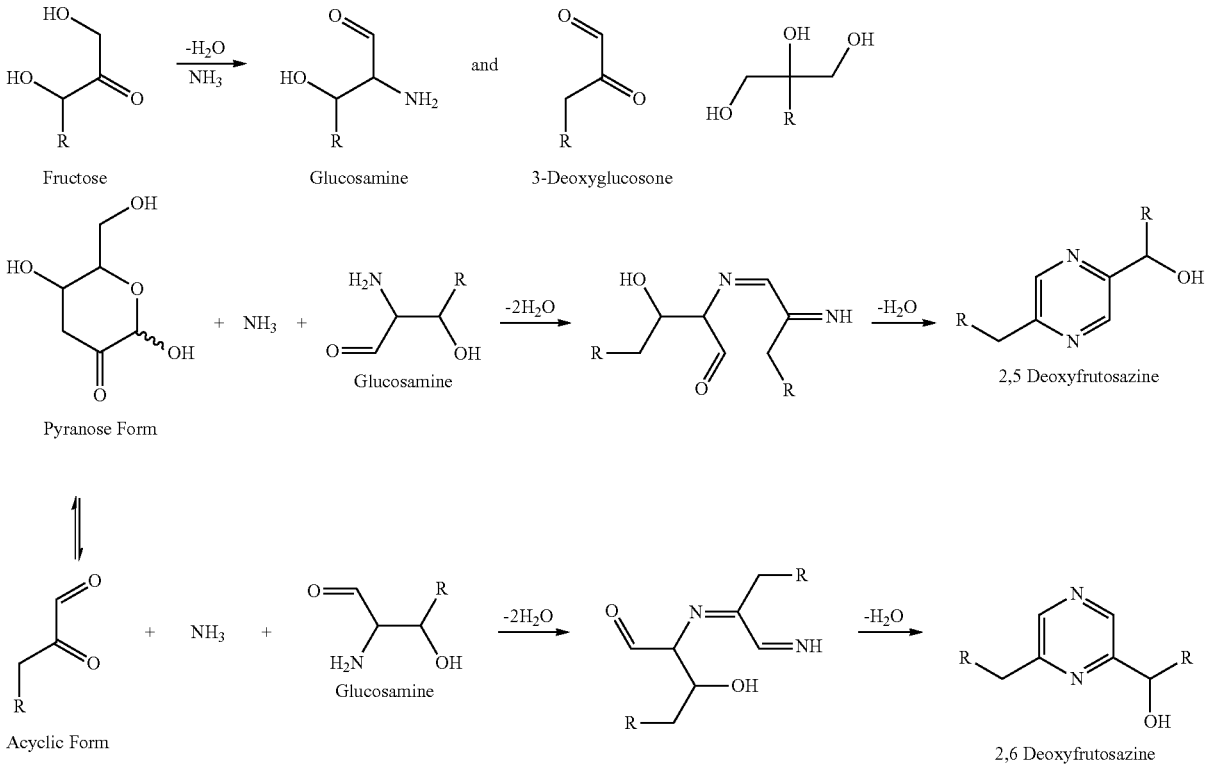

For each fructosazine/deoxyfructosazine generated in the SAT process there is a release four molecules of water to the medium (stoichiometric ratio 1:4). The sealed atmosphere prevents the evaporation of water and so it can be explained that liquid is generated by the SAT process despite that maintenance of moisture content in the blend around 14% (w/w).

Other important aspect verified after the SAT process was change in the blend colour. The darkness of the blend can be associated with two factors. First, the non-enzymatic oxidation of polyphenols and degradation of carotenoids, since these compounds make an important contribution to the yellow and orange colours in blend. Second, the generation of melanoidins that are brown nitrogenous polymers or copolymers produced by the non-enzymatic Maillard reaction (Nursten, 2005; Echavarría, A. P., et al, *Melanoidins Formed by Maillard Reaction in Food and Their Biological Activity,* Food Engineering Reviews, v.4, p. 203-223, 2012).

Thus, it can be concluded that the SAT process can extensively modify the chemical profile of the tobacco blend. The non-enzymatic Maillard reaction has been shown to play an important role in the SAT chemical profile change and the Maillard reaction products appear to be related to increasing of sweet, creamy, caramel and toasted notes of the tobacco following the SAT process. Also, the SAT process is able to maximize the reaction of ammonium/ammonia and reducing sugars due to sealed atmosphere, whilst the Browning process (which is not sealed) maximizes the reaction of amino acids with reducing sugars. The decrease in ammonium/ammonia can reduce the pH of blend/smoke and consequently decrease the sensory and physiological perception of impact/irritation after SAT process. Also, the water generated by the SAT process appears to be a result of the chemical reactions, mainly from ammonium/ammonia and reducing sugars. Finally, an increase in the blend darkness may be associated with the degradation of polyphenols and carotenoids and the generation of melanoidins by the non-enzymatic Maillard reaction.

EXAMPLE 3

This work was done to assess the changes in taste profile after the SAT process by using the high-throughput screening methodology with flow injection analysis coupled to a high-resolution mass spectrometry detection system (HTS-FIA-HRMS) and multivariate analysis.

Sample Description 19 samples of reconstituted tobacco were used (referred to herein as RECON), as well as two blend samples of commercial combustible brand (referred to herein as Lucky Strike—Brazil). Details of the treatment of the samples can be found in Table 3.

TABLE 3

Samples submitted to SAT process under different conditions (time and temperature).

| Sample Type | Time (Hours) | Temperature (° C.) | Additive |
|---|---|---|---|
| RECON | Control* | Control* | |
| RECON | 48 | 110 | |
| RECON | 36 | 110 | |
| RECON | 60 | 120 | |
| RECON | 24 | 90 | |
| RECON | 60 | 90 | |
| RECON | 48 | 90 | |

TABLE 3-continued

Samples submitted to SAT process under different conditions (time and temperature).

| Sample Type | Time (Hours) | Temperature (° C.) | Additive |
|---|---|---|---|
| RECON | 12 | 120 | |
| RECON | 24 | 120 | |
| RECON | 60 | 110 | |
| RECON | 36 | 120 | |
| RECON | 48 | 120 | |
| RECON | 12 | 90 | |
| RECON | 24 | 110 | |
| RECON | 12 | 110 | |
| RECON | 36 | 90 | |
| RECON | 36 | 110 | 15% (w/w) inverted sugar |
| RECON | 12 | 110 | 15% (w/w) inverted sugar and 1% (w/w) lactic acid |
| RECON | 12 | 110 | 15% (w/w) inverted sugar |
| Lucky Strike - Blend | Control* | Control* | |
| Lucky Strike - Blend | 24 | 90 | |
| Lucky Strike - Blend | 48 | 90 | |
| Lucky Strike - Blend | 72 | 90 | |
| Lucky Strike - Blend | 24 | 120 | |
| Lucky Strike - Blend | 48 | 120 | |
| Lucky Strike - Blend | 72 | 120 | |

*Sample not submitted to SAT process.

Sample Analysis

Following treatment, the samples were ground by ball-milling and sifted through a 0.5 mm mesh sieve. A 200 mg portion of the ground tobacco was used for extraction followed by HTS-FIA-HRMS in accordance with the process disclosed in International Patent Publication No. WO 2018/007789.

All analyses were performed using an ACQUITY I-CLASS UPLC® (Waters®, USA) module coupled with SYNAPT G2-Si® (Waters®, USA) mass spectrometer using the HTS-FIA-HRMS methodology. Each sample was analysed in three independent replicates.

Results

The first taste profile of the treated reconstituted tobacco (RECON) showed a significant increase in the dark notes and a decrease in the bright notes following the SAT process. The second taste profile showed a significant increase in spicy, coffee and woody notes and a decrease in hay notes following the SAT process.

The temperature and time of the SAT process was seen to affect the taste profile in different ways. In summary, a greater increase in the dark and spicy notes was seen following treatment at temperatures higher than 110° C. after 12 hours of SAT process treatment. At temperatures lower than 110° C., only minor changes were observed, even, for example, after SAT process treatment for 24 hours at 90° C.

The addition of 15% of inverted sugar increases the woody and coffee notes in comparison to control samples and other samples without use of additives.

The effects of adding both inverted sugar (15%) and lactic acid (1%) were also evaluated and these additives were shown to result in a major increase in the woody notes and minor increases in the coffee and spicy notes. Furthermore, significant decreases were seen in the hay and bread notes after SAT process treatment of the Lucky Strike tobacco blend compared to the control.

As with the treated reconstituted tobacco, several changes in the Lucky Strike tobacco blend were identified after SAT process in comparison to control. The Lucky Strike taste profile is predominantly bright, with slight earthy and aromatic notes. After the SAT process, the taste profile of this blend became bright and dark. Moreover, the Lucky Strike blend showed increased spicy and woody notes after the SAT process. In contrast, the resinous and coffee notes were preserved in the blend after the SAT process.

EXAMPLE 4

This further work was done to assess the changes in taste profile after treating tobacco blend samples with the SAT process by using the high-throughput screening methodology with flow injection analysis coupled to a high-resolution mass spectrometry detection system (HTS-FIA-HRMS) and multivariate analysis.

Sample Description 14 commercial cigarette tobacco blend (Lucky Strike blend) samples were analysed. 4 replicate control samples were collected from different positions within the reactor and 1 composite control sample was formed by mixing samples from these different positions. 8 replicate samples treated by the SAT process were collected from different positions within the reactor and 1 composite sample was formed by mixing samples from these different positions. The composite samples were prepared with the same amount of each sample or control after grinding by ball-milling to obtain a representative sample.

Sample Analysis

The samples were ground by ball-milling and sifted through a 0.5 mm mesh sieve. A 200 mg portion of ground tobacco was used for extraction followed by HTS-FIA-HRMS in accordance with the process disclosed in International Patent Publication No. WO 2018/007789.

All analyses were performed using an ACQUITY I-CLASS UPLC® (Waters®, USA) module coupled with SYNAPT G2-Si® (Waters®, USA) mass spectrometer by using the HTS-FIA-HRMS methodology. Each sample was analysed in three independent replicates.

Results

The first taste profile of the SAT treated Lucky Strike blend shows a significant increase in the dark notes and a decrease in the earthy notes. The second taste profile shows a significant increase in spicy and woody notes and a decrease in bread notes after SAT process.

In addition, the taste profile of the composite samples showed very similar changes. The relative standard deviation (RSD) was less than 14.4%, which indicates a homogenous taste profile of samples collected at different positions at the reactor. This demonstrates that the process may be scaled up by the use of a reactor whilst still achieving the aforementioned changes to the taste profile.

The data shows that the tobacco material undergoes significant changes throughout processing. Further, the chemical changes in the tobacco are clearly different to those that are achieved using the known Browning processes of tobacco treatment.

It has been shown that these changes translate into changes in the organoleptic properties of the processed material, which are discernible in the smoke produced when the treated tobacco is combusted, for example in a cigarette. The organoleptic properties of this smoke are described in very positive terms by expert smokers, indicating that the tobacco treatment leads to the production of the treated material with beneficial and desirable properties. This is both in terms of the reduction in some undesirable tobacco constituents, and improved organoleptic properties.

In order to address various issues and advance the art, the entirety of this disclosure shows by way of illustration various embodiments in which the claimed inventions may be practiced and provide for superior methods, apparatus and treated tobacco materials and extracts therefrom. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A process for treating tobacco material to increase the content of stable fructosazines and deoxyfructosazines comprising:

securing tobacco starting material within a sealed reactor preventing the ingress or exit of any gas or liquid;

heating the tobacco starting material to a temperature of from 60° C. to 200° C. for a period of from 6 hours to 120 hours;

producing a treated tobacco material comprising stable fructosazines and stable deoxyfructosazines by reacting one or more reducing sugars with ammonium and/or ammonia in the tobacco starting material to produce the stable fructosazines and deoxyfructosazines as a primary reaction pathway;

allowing the temperature of the treated tobacco material to cool down to room temperature whilst secured within the sealed reactor; and removing the treated tobacco material from the sealed reactor;

wherein there is a reduction in the content of ammonia in the treated tobacco material compared to the content of ammonia in the tobacco starting material; and wherein the moisture content of the tobacco material before and during treatment is between 5% and 42%.

2. The process of claim 1, wherein the tobacco material is heated to a temperature of from 90° C. to 120° C.

3. The process of claim 1, wherein the tobacco is heated for a period of from 12 to 72 hours.

4. The process of claim 1, wherein the cooling of the heated tobacco to room temperature occurs over a period of from at least 1 hour to 72 hours.

5. The process of claim 1, wherein the cooling allows volatile compounds to be reabsorbed by the treated tobacco material.

6. The process of claim 1, wherein the tobacco starting material comprises one or more selected from the group consisting of green tobacco and dried tobacco.

7. The process of claim 1, wherein the tobacco starting material comprises cured tobacco.

8. The process as claimed in claim 7, wherein the cured tobacco is one or more selected from the group consisting of flue cured, air cured, dark air cured, dark fire cured and sun cured tobacco.

9. The process of claim 1, wherein the tobacco starting material is one or more selected from the group consisting of cut rag, thrashed leaf and tobacco stems.

10. The process of claim 1, wherein the tobacco starting material is reconstituted tobacco.

11. The process of claim 1, wherein the tobacco starting material comprises tobacco and one or more additives, wherein the one or more additive is selected from the group consisting of: sugars, organic acids (such as lactic acid), humectants, top flavours and casings.

12. The process of claim 1, wherein there is a reduction in the content of total sugars in the treated tobacco material compared to the content in the tobacco starting material.

13. The process of claim 1, wherein the treated tobacco material has improved organoleptic properties and/or reduced undesirable sensorial attributes.

14. Tobacco material that has been treated according to the process of claim 1.

15. A tobacco industry product comprising the tobacco material of claim 14.

16. A method of making a tobacco industry product comprising:

obtaining the tobacco material of claim 14, and manufacturing said tobacco industry product.

17. A tobacco extract manufactured from the tobacco material of claim 14.

18. A nicotine-delivery system comprising an extract according to claim 17.

19. A delivery system for delivering tobacco alkaloids other than nicotine, comprising an extract according to claim 17.

20. The process of claim 1, wherein the method involves no fermentation or essentially no fermentation and/or wherein the tobacco starting material is heated for a period of from 36 to 120 hours.

21. The process of claim 1, wherein the one or more reducing sugars comprises 5-Hydroxy-6-methyl-3-pyridinyl)methyl alpha-D-glucopyranoside, [5-Hydroxy-4-(hydroxymethyl)-6-methyl-3-pyridinyl]methyl beta-D-glucopyranoside, 6-(alpha-D-Glucosaminyl)-1D-myo-inositol, 6-O-(4-Aminobutanoyl)-D-glucopyranose, D-Arabinofuranose, Raffinose, Trisaccharide like Raffinose isomer 1, Trisaccharide like Raffinose isomer 2, Trisaccharide like Raffinose isomer 3, sucrose, or a combination thereof.

22. The process of claim 1, wherein the tobacco is selected from Virginia, Burley, Oriental, Comum, Amarelinho and Maryland tobaccos, and blends of any of these types; and/or wherein the tobacco is air cured, dark air cured, dark fire cured, and sun cured tobacco.

23. The process of claim 1, wherein the stable fructosazines and deoxyfructosazines comprise 2-Deoxy-2-[(2-hydroxybenzyl) amino]-D-glucopyranose, 2-Deoxy-2-{[(2S)-2-({[(2-methyl-2-propanyl) oxy]carbonyl} amino) propanoyl]amino}-D-glucopyranose, D-Fructosazine, (1R, 2S,3R)-1-(2-Methyl-4-pyrimidinyl)-1,2,3,4-butanetetrol, 2,5-Deoxyfructosazine, 2,6-Deoxyfructosazine, 4-(3-Methyl-2-pyrazinyl)-1,2,3-butanetriol, or a combination thereof.

24. The process of claim 1, wherein the method further comprises reacting amino acids with one or more reducing sugars in the tobacco starting material to produce Amadori compounds which degrade to Maillard reaction products, as a secondary reaction pathway.

25. The process of claim 1, wherein the stable fructosazines and deoxyfructosazines produce one or more furans, pyrroles and pyrazines on pyrolysis.

26. The process of claim 1, wherein the content of stable fructosazines and deoxyfructosazines in the treated tobacco material is increased relative to tobacco material treated in a non-sealed reactor; and wherein the content of stable fructosazines and deoxyfructosazines in the treated tobacco material is increased relative to tobacco material comprising added ammonia.

27. A process for treating tobacco material to increase the content of stable fructosazines and deoxyfructosazines comprising:

securing tobacco starting material within a sealed reactor preventing the ingress or exit of any gas or liquid;

heating the tobacco material to a temperature of from 60° C. to 200° C. for a period of from 6 hours to 120 hours;

producing a treated tobacco material comprising stable fructosazines and stable deoxyfructosazines by reacting one or more reducing sugars with ammonium and/or ammonia in the tobacco starting material to produce the stable fructosazines and deoxyfructosazines as a primary reaction pathway;

allowing the temperature of the tobacco material to cool down to room temperature whilst secured within the sealed reactor; and removing treated tobacco material from the sealed reactor;

wherein there is a reduction in the content of ammonia in the treated tobacco material compared to the content in the tobacco starting material; and wherein there is no ammonia or ammonium added to the sealed reactor before or during the process.

* * * * *